US006988590B1

(12) United States Patent
Knight

(10) Patent No.: US 6,988,590 B1
(45) Date of Patent: Jan. 24, 2006

(54) OIL DELIVERY SYSTEM

(75) Inventor: David L. Knight, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 137 days.

(21) Appl. No.: 10/307,614

(22) Filed: Dec. 2, 2002

(51) Int. Cl.
*F16N 13/10* (2006.01)

(52) U.S. Cl. ..... 184/27.1; 184/26; 184/31; 184/103.2; 184/108; 123/198 C

(58) Field of Classification Search ..... 184/26, 184/27.1, 31, 103.2, 103.1, 108; 123/65 B, 123/198 C, 73 AD, 198 DA
See application file for complete search history.

(56) References Cited

U.S. PATENT DOCUMENTS 4,299,307 A * 11/1981 Scott ..... 184/103.1
4,734,682 A * 3/1988 Bond, Jr. ..... 340/614
4,989,560 A * 2/1991 Rasdal et al. ..... 123/196 S
5,947,372 A * 9/1999 Tiernan ..... 236/94
6,622,824 B2 * 9/2003 Roehrborn ..... 184/6.1
2003/0080161 A1 * 5/2003 Burger ..... 222/608

* cited by examiner

*Primary Examiner*—David M. Fenstermacher
(74) *Attorney, Agent, or Firm*—Reising, Ethington, Barnes, Kisselle, P.C.

(57) ABSTRACT

A modular oil delivery system has a mount with at least one passage, a flange and a body depending from the flange. A mounting bracket is carried by the mount to support an oil pump having an oil outlet in fluid communication with at least one passage in the mount. A float arm is pivotally supported relative to the mounting bracket and is constructed and arranged to be responsive to the level of the oil in the reservoir. An oil pressure sensor is supported by either the mounting bracket, the body, or the flange. The oil pressure sensor is in fluid communication with at least one passage in the mount and with the oil outlet of the oil pump to monitor the pressure of oil discharged from the oil pump.

20 Claims, 4 Drawing Sheets

OIL DELIVERY SYSTEM

FIELD OF THE INVENTION

This invention relates generally to an oil delivery system for a combustion engine.

BACKGROUND OF THE INVENTION

Internal combustion engines, both two and four cycle, typically include an oil pump which transfers oil to a crank case of the combustion engine. The oil pump typically draws oil from a remote reservoir that is separate and spaced from the oil pump. For two cycle engine applications, the oil pump may deliver measured amounts of oil directly into the crank case for lubrication.

In addition to the oil pump communicating with a remote oil reservoir, typically a remote oil pressure sensor that is separate and spaced from the oil pump and oil reservoir communicates with the oil pump to monitor the pressure of oil discharged from the oil pump. Also, a remote oil level sensor that is a separate and spaced component may be incorporated to communicate with the oil reservoir to indicate to a user when the level of oil is low.

Both in manufacture and in service, by having the oil pump, the oil pressure sensor, and the oil level sensor as separate and individual components, the manufacture, assembly, and serviceability is relatively costly.

SUMMARY OF THE INVENTION

A modular oil delivery system is arranged in a self contained package that can be mounted at least partially within an oil reservoir as a single unit. The modular oil delivery system has a mount with at least one passage and a flange with a body depending from the flange. A mounting bracket is carried by either the flange or the body. A float arm is pivotally supported relative to the mounting bracket. The float arm is constructed and arranged to be responsive to the level of the oil in the reservoir. An oil pump is supported by the mounting bracket and has an oil outlet in fluid communication with at least one passage in the mount. An oil pressure sensor is supported by either the mounting bracket, the body, or the flange. An oil pressure sensor is in fluid communication with at least one passage in the mount and with the oil outlet of the oil pump.

Objects, features and advantages of this invention include a modular oil delivery system providing a self contained package that can be mounted as a single unit within an oil reservoir, is of relatively simple design and economical manufacture, the assembly is cooled by being immersed in the oil reservoir, and facilitates the ease of serviceability and assembly.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
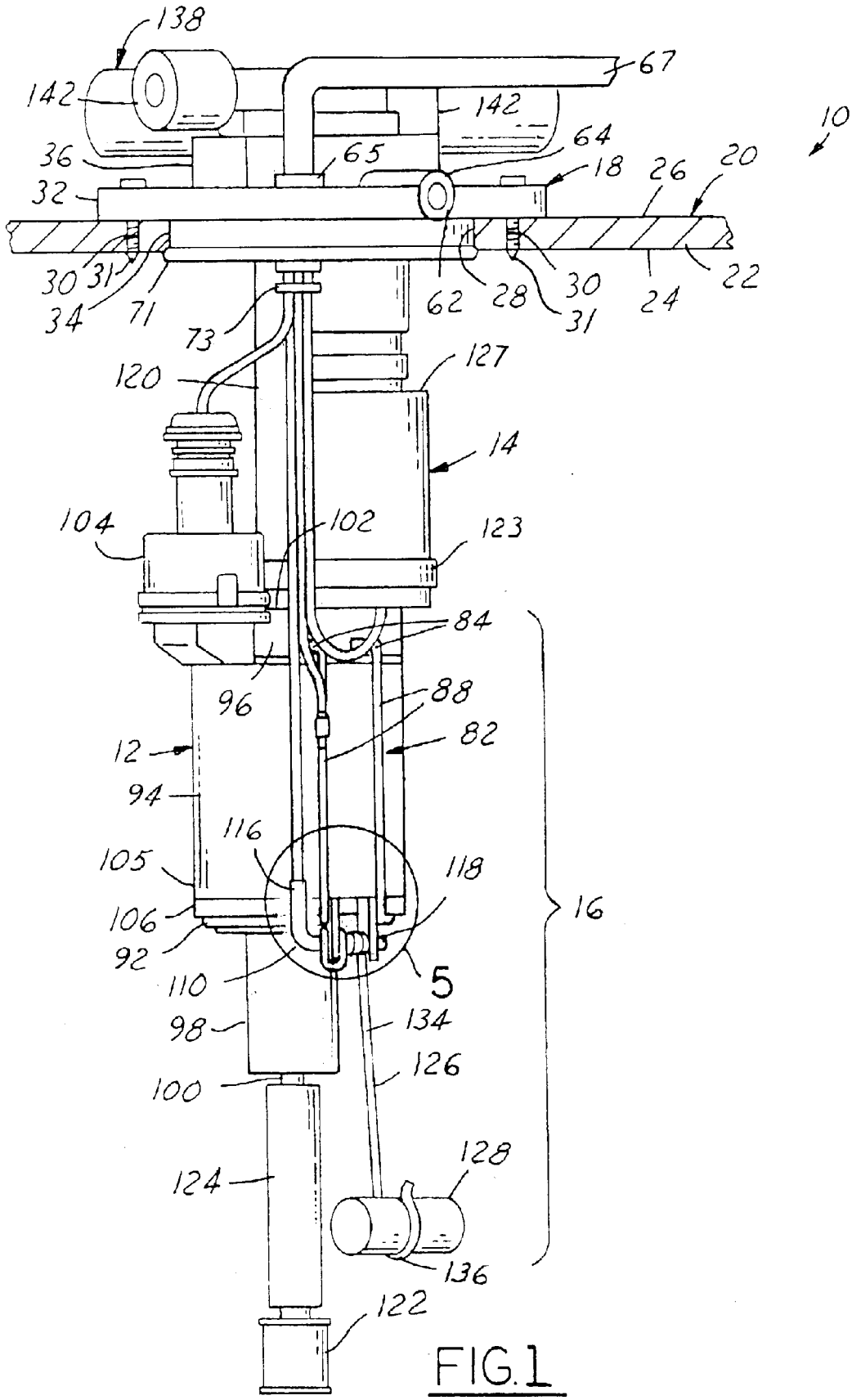
FIG. 1 is a side view of a modular oil pump assembly according to one embodiment of the present invention.

Referring to FIG. 1 a presently preferred construction of a modular oil pump assembly is shown generally at 10. The assembly 10 has an oil pump 12, an oil pressure sensor 14, and an oil level sensor 16 arranged in a self-contained package depending from a mount 18. The assembly 10 can be mounted at least partially within an oil reservoir 20 as a single unit.

The oil reservoir 20, shown in part in FIG. 1, has a wall 22 with an inner surface 24 and an outer surface 26. The reservoir 20 has at least one opening 28 sized to receive at least in part the modular oil pump assembly 10. The assembly 10 is preferably mounted to the outer surface 26 of the wall 22. Fastener openings 30 may be formed in the wall 22 to facilitate attachment of the assembly 10 to the reservoir 20 via fasteners 31. However, it should be recognized that any suitable mechanism for attaching the assembly 10 to the reservoir 20 may be used, such as clamps or clips, adhesives, threaded cap, and the like.

Figure 2:
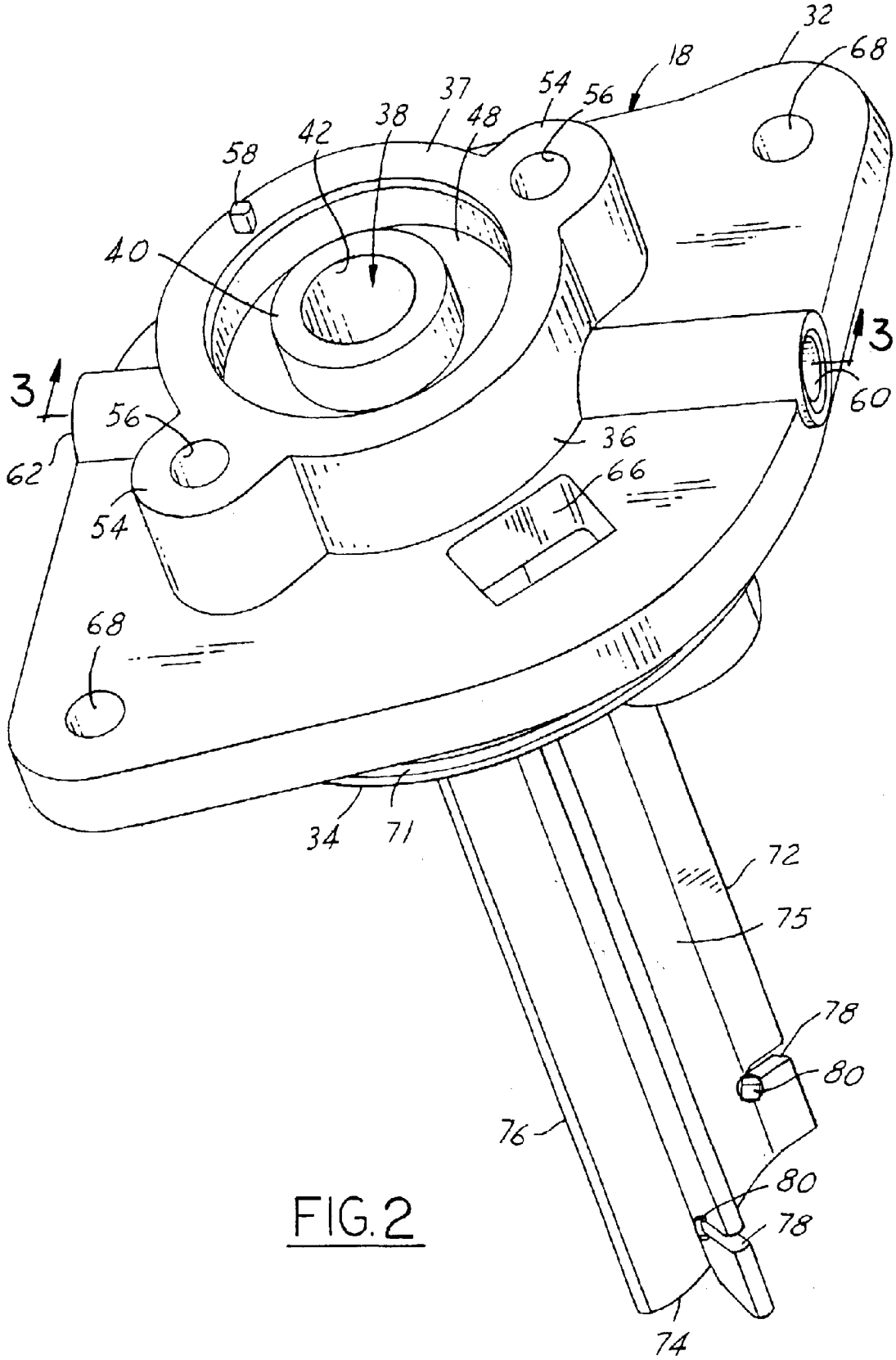
FIG. 2 is a perspective view of a mount of the modular oil pump assembly of FIG. 1.
Figure 3:
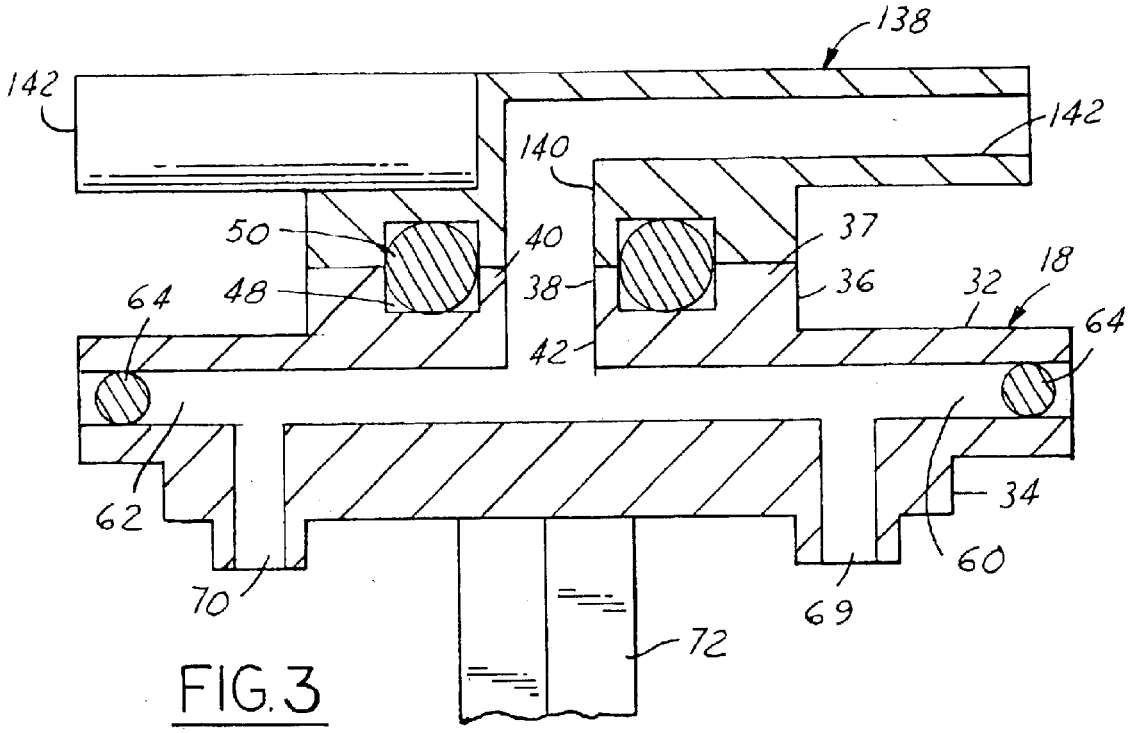
FIG. 3 is a partial cross-sectional side view of the mount taken along line 3—3 in FIG. 2 with a manifold attached thereto.

The mount 18 has a flange 32 overlying the outer surface 26 of the reservoir wall 22, a lower boss 34 received in the opening 28 and an upper boss 36. As shown in FIGS. 2 and 3, the upper boss 36 has a pair of generally concentric outer and inner annular walls 37, 40 with an annular channel 48 defined therebetween. The inner wall 40 has an inner surface 42 defining a passage 38 extending through the upper boss 36 and into the flange 32. The channel 48 is preferably sized for receiving a seal 50, for example an O-ring to facilitate a fluid tight seal between the upper boss 36 and a mating surface of a manifold 138 (FIG. 1). The upper boss 36 preferably has at least one, and as shown here has a pair of protrusions 54 extending radially outwardly from the outer wall 37 having threaded openings 56 formed therein for fastening the manifold 138 to the upper boss 36. Preferably, at least one locating pin 58 is formed extending upwardly from the upper boss 36 for positioning the mount 18 relative to the manifold 138 during assembly.

The passage 38 preferably branches into a pair of passages 60, 62 within the flange 32 for fluid communication with the oil pressure sensor 14 and the oil pump 12, respectively. As best shown in FIG. 3, the passages 60, 62 extend generally away from one another laterally through the flange 32. Preferably, a plug 64 is pressed or otherwise inserted and maintained in an end of each passage 60, 62 near the perimeter of the flange 32 to prevent fluid from flowing out of the ends of the passages 60, 62. It should be recognized that the necessity for the plugs 64 results from the fact that the passages 60, 62 are preferably formed as a through passage in manufacture.

As best shown in FIG. 2, the flange 32 preferably has an opening 66 formed therethrough so an electrical connector 65 (FIG. 1) can be plugged and sealed therein. Wires from a wire harness 67 are plugged into the electrical connector 65 at both ends of the connector 65 enabling the wires to effectively pass through the mount 18 to the fuel pump 12, the oil pressure sensor 14, and the oil level sensor 16.

Preferably a tie-wrap 73 is fastened around the wires inside the reservoir 20 to secure them in place, and to prevent a user from disrupting the wire connections within the assembly 10. Additionally, at least one and preferably a pair of openings 68 are formed adjacent the perimeter of the flange 32 and in alignment with the openings 30 in the oil reservoir 20 to facilitate attaching the mount 18 to the oil reservoir 20 using suitable fasteners.

As best shown in FIG. 3, the lower boss 34 depending from the flange 32 has at least one and preferably a pair of passages 69, 70 that intersect the passages 60, 62, respectively. The passages 69, 70 extend downwardly from passages 60, 62 and exit the lower boss 34 for fluid communication with the oil pressure sensor 14 and the oil pump 12, respectively. The lower boss 34 is sized to fit within the opening 28 of the oil reservoir 20 and is preferably sized to facilitate a fluid tight seal therein. To further facilitate a fluid-tight seal between the mount 18 and the oil reservoir 20, a seal 71 (FIGS. 1 and 2), for example an O-ring may be disposed between the lower boss 34 and the opening 28.

As shown in FIG. 2, the mount 18 preferably has a body 72 depending from the lower boss 34. The body 72 has a free end 74 and a pair of opposing sides 75, 76 that are preferably generally concave in form. Preferably, one of the sides 75 has a pair of lateral slots 78 extending therein and terminating at a generally enlarged annular opening 80 for receiving at least in part a mounting bracket 82.

Figure 4:
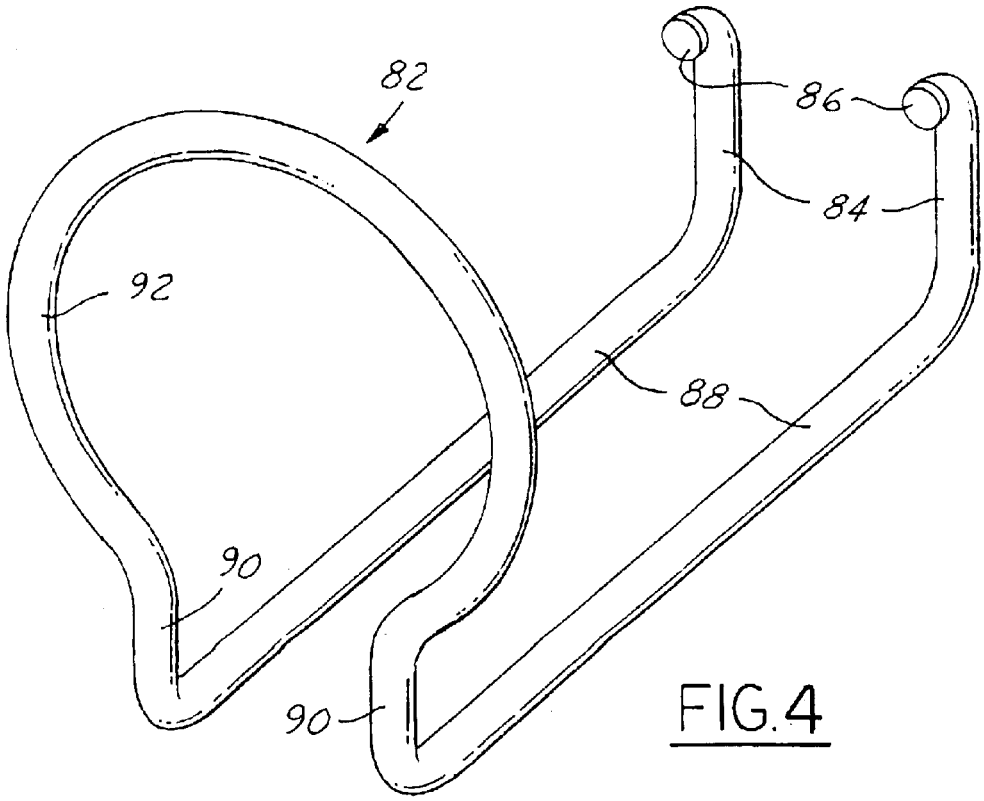
FIG. 4 is a perspective view of a mounting bracket from the modular oil pump assembly of FIG. 1.

As shown in FIG. 4, the mounting bracket 82 of the oil level sensor 16 is preferably formed from a continuous piece of electrically conductive material, such as a metallic wire. The mounting bracket 82 preferably has a pair of generally c-shaped fingers 84 terminating in bent free ends 86. The fingers 84 are spaced laterally from one another and are arranged so that they can be received in the slots 78 of the body 72. The fingers 84 are preferably sized to be received in the openings 80 to retain the bracket 82 on the body 72. The fingers 84 transition into a pair of generally parallel arms 88 that extend to a pair of laterally extending and generally parallel legs 90. The legs 90 preferably transition into a generally circular base 92 that is sized to fit around a portion of the oil pump 12 to maintain the oil pump 12 adjacent the body 72.

As best shown in FIG. 1, the oil pump 12 has a main body 94 with upper and lower portions 96, 98, respectively. The upper and lower portions 96, 98 are preferably necked down from the main body 94 and extend generally axially therefrom. An inlet 100 and an outlet 102 extend preferably axially from the lower and upper portions 98, 96 providing for oil flow from the reservoir 20 into the oil pump 12, and out of the oil pump 12 to the engine, respectively. The outlet 102 of the oil pump 12 is connected to the passage 70 of the mount 18, preferably by a hose 120, providing for fluid communication of the outlet 102 with the passage 70. The inlet 100 of the oil pump 12 is preferably connected to a filter 122 located near the bottom of the reservoir 20 by a hose 124 providing for fluid communication between the filter 122 and the inlet 100. An electrical connector 104 is preferably formed integrally with a top portion of the main body 94 and is arranged to receive wires from the wire harness 67 to provide power to the oil pump 12.

Figure 5:
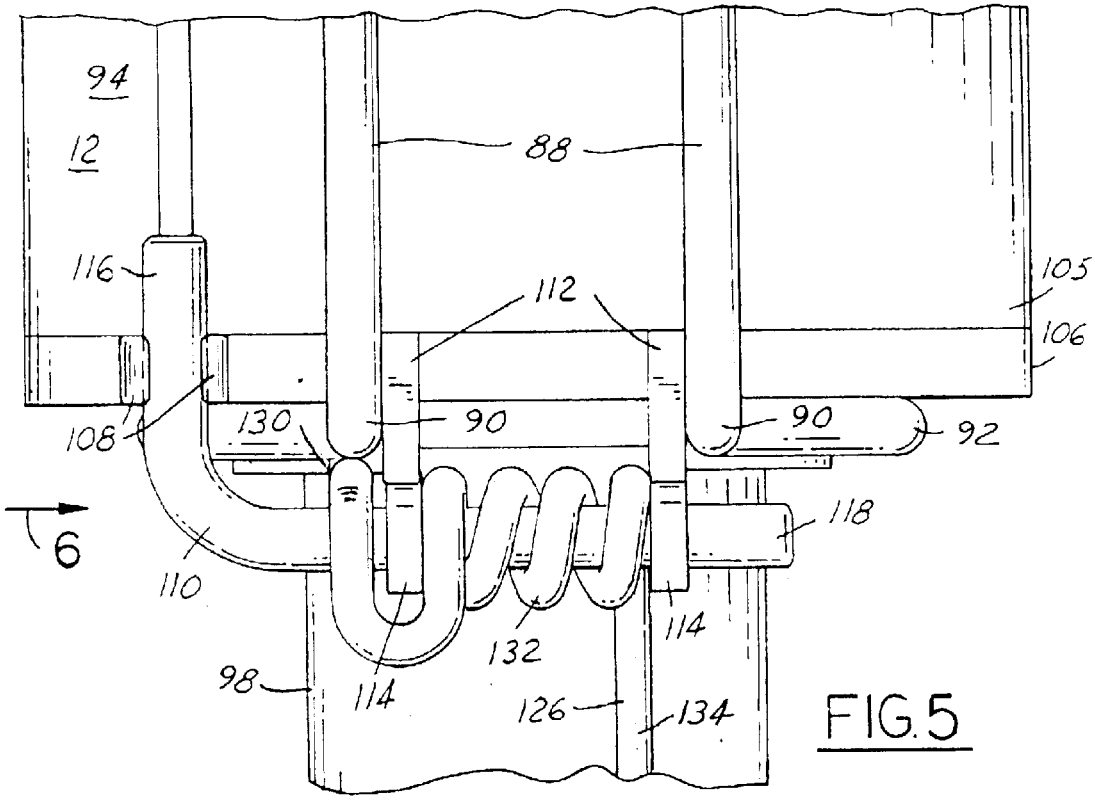
FIG. 5 is a partial front view of a float arm pivotally supported by a hinge pin of the modular oil pump assembly of FIG. 1.
Figure 6:
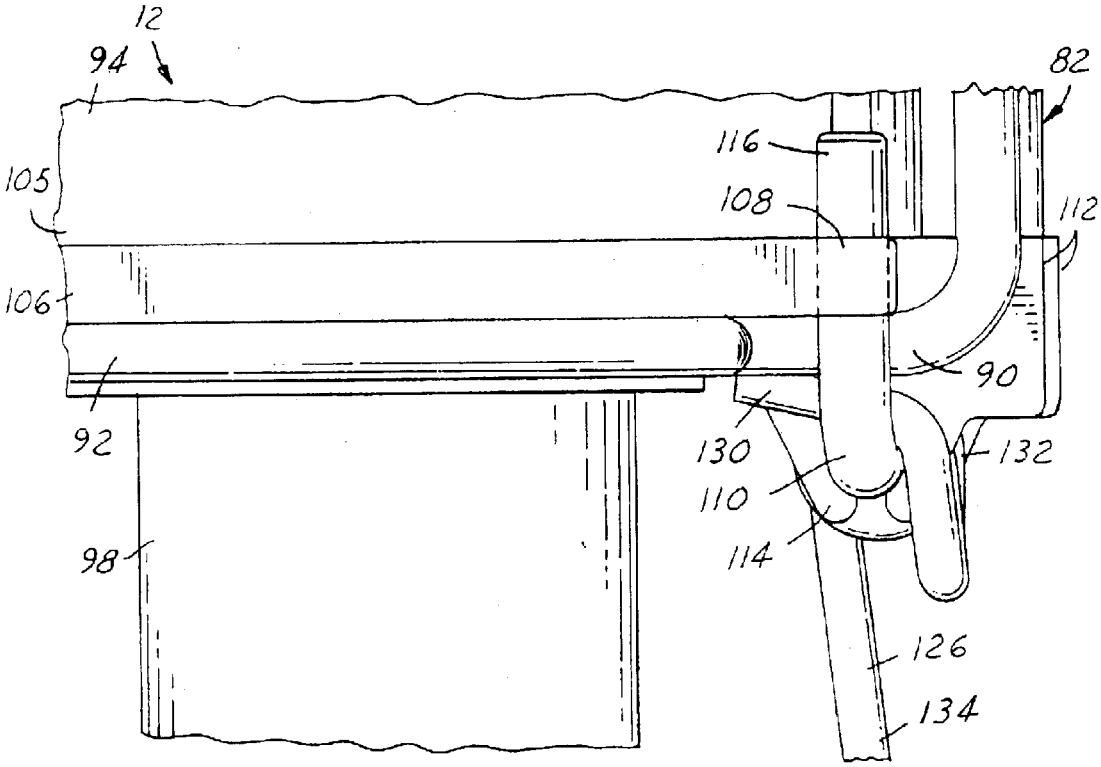
FIG. 6 is a view looking in the direction of arrow 6 in FIG. 5 showing the float arm making electrical contact with the mounting bracket indicating a low oil condition.

As best shown in FIGS. 5 and 6, the main body 94 has a base 105 preferably having an isolator plate 106 attached thereto. The isolator plate 106 is preferably constructed from a non-electrically conductive material such as plastic, rubber, or any suitable polymer. The isolator plate 106 has a pair of clip fingers 108 extending outwardly therefrom and at least one and preferably a pair of flanges 112 with clip fingers 114 extending outwardly therefrom. The clip fingers 108, 114 receive and retain a portion of a hinge pin 110 between them to secure the hinge pin 110 to the isolator plate 106, while the flanges 112 facilitate alignment of a float arm 126 relative to the mounting bracket 82.

As shown in FIG. 5, the hinge pin 110 is generally L-shaped and preferably constructed from an electrically conductive metallic material. One leg 116 of the hinge pin 110 extends generally perpendicular to the isolator plate 106 for disposal within the clip fingers 108, while another leg 118 extends generally parallel to the isolator plate 106 for disposal within the clip fingers 114. The leg 116 is preferably provided with a mechanism for attaching a wire of the wire harness 67 thereto. It should be recognized that any suitable mechanism may be used to attach a wire from the wire harness 67 to the leg 116 of the hinge pin 110, for example, a male plug and a female socket arrangement, a spring clip, a soldered connection, or the like.

The oil level sensor 16 comprises the mounting bracket 82, the hinge pin 110, and the float arm 126. As best shown in FIGS. 5 and 6, the float arm 126 has an upper end 130 that transitions into a preferably coiled portion 132 wrapped around the hinge pin 110. The float arm 126 has an intermediate portion 134 of a predetermined length extending from the coiled portion 132 such that a lower end 136 of the float arm 126 (FIG. 1) extends generally adjacent to a bottom surface of the oil reservoir 20 (not shown) when there is a low level of oil within the oil reservoir 20. The lower end 136 is preferably u-shaped and wraps around a float 128 to secure the float 128 to the float arm 126. The float 128 is constructed from any suitable material that is buoyant in oil to maintain the float 128 on the surface of the oil within the oil reservoir 20. In this manner, the float 128 and float arm 126 are responsive to the level of oil in the reservoir 20.

The float arm 126 is pivotally supported by the hinge pin 110 so that when there is a low level of oil within the oil reservoir 20, the upper end 130 of the float arm 126 makes electrical contact with one of the legs 90 of the mounting bracket 82. When the contact results between the float arm 126 and the mounting bracket 82, an electrical circuit is completed between the wire from the wire harness 67 attached to the hinge pin 110, the hinge pin 110, the float arm 126, the mounting bracket 82, and the wire from the wire harness 67 attached to the mounting bracket 82. In this manner, the float arm 126 triggers a switch that completes the circuit when closed to send an alert signal that is conveyed to an operator of a vehicle so the operator is aware of the low oil level. For example, the signal may activate a light on an instrument panel (not shown). The circuit is only completed when the upper end 130 of the float arm 126 contacts the mounting bracket 82. Depending on the particular arrangement of the system 10, when the electrical circuit is completed, the vehicle may be subjected to a safe operating mode, such as that provided by limiting the operational performance of the engine. Otherwise, the operator may simply be notified of the low oil level condition such as, for example, with an indicator light (not shown). Other mechanisms or switches may be used to indicate the low oil level condition in the reservoir 20.

The oil pressure sensor 14 is preferably received against the side 75 of the body 72. A tie-wrap 123 is preferably used to facilitate attachment of the oil pressure sensor 14 to the body 72, though any suitable fastening mechanism may be used. The tie-wrap 123 preferably extends around the oil pressure sensor 14, the body 72, and the upper portion 96 of the oil pump 12. As such, the tie-wrap 123 maintains the position of the sensor 14, and the oil pump 12 relative to the body 72. The oil pressure sensor 14, though shown supported by the body 72, could otherwise be supported by the mounting bracket 82 or the mount 18. The oil pressure sensor 14 has an upper end 127 in fluid communication with the passage 69 of the mount 18. As such, the oil pressure sensor 14 is in fluid communication with the outlet 102 of the oil pump 12 via the mount 18.

As shown in FIG. 3, the manifold 138 is mounted to the upper boss 36 of the mount 18 and has at least one passage 140 in fluid communication with the passage 38 of the mount 18. The passage 140 preferably branches into a plurality of passages 142 to provide oil flow where needed, such as a crank case (not shown), and/or a fuel rail (not shown) of a fuel injection engine.

While the forms of the invention herein disclosed constitute presently preferred embodiments, many others are possible. It is not intended herein to mention all the possible equivalent forms or modifications of the invention. It is further understood that the terms used herein are merely descriptive rather than limiting, and various changes may be made without departing from the spirit or scope of this invention as defined by the following claims.

I claim:

1. A modular oil delivery system for mounting within an oil reservoir through an opening in a wall of the reservoir to supply oil to an operating combustion engine for lubrication, comprising:

a mount having a flange constructed to close the opening and be carried by the wall of the reservoir, at least one passage communicating with the exterior of the flange to supply oil to the engine, a body depending from the flange into the reservoir, and a mounting bracket carried by the mount;

a float arm pivotally supported relative to the mounting bracket, inside the bracket and constructed and arranged to be responsive to the level of oil in a reservoir, an oil pump carried by the body, supported by the mounting bracket and inside the reservoir when the flange closes the opening and is carried by the wall of the reservoir and having an oil outlet in fluid communication with said at least one passage; and an oil pressure sensor supported by at least one of the mounting bracket, the body, and the flange, the oil pressure sensor being in fluid communication with the oil outlet of the oil pump to sense the pressure of oil discharged from the oil pump to the operating engine, wherein the oil delivery system is a self contained package for mounting at least partially within an oil reservoir as a single unit with the oil pump and float arm inside the reservoir when the flange closes the opening and is carried by the wall of the reservoir.

2. The modular oil delivery system of claim 1 further comprising an isolator plate adjacent to the oil pump and formed of a material that is not electrically conductive to prevent electrical communication between the mounting bracket and the oil pump.

3. The modular oil delivery system of claim 2 further comprising a hinge pin carried by the isolator plate wherein the hinge pin and mounting bracket are electrically conductive.

4. The modular oil delivery system of claim 3 wherein the float arm has an electronically conductive upper end and is pivotally carried by the hinge pin so that in a low oil condition the upper end of the float arm makes electrical contact with the mounting bracket.

5. The modular oil delivery system of claim 4 wherein the isolator plate has at least one flange extending outwardly therefrom supporting the hinge pin at least in part and maintaining alignment of the float arm relative to the mounting bracket.

6. The modular oil delivery system of claim 1 further comprising a manifold attached to the mount and having at least one passage in fluid communication with the at least one passage of the mount.

7. The modular oil delivery system of claim 1 wherein the mount has two passages depending from the flange, one of said two passages providing fluid communication with the oil outlet of the oil pump and the other of the two passages providing fluid communication with the oil pressure sensor.

8. The modular oil delivery system of claim 7 wherein the two passages join into a single common passage within the mount.

9. The modular oil delivery system of claim 8 further comprising a manifold attached to the mount and having at least one passage in fluid communication with the common passage.

10. The modular oil delivery system of claim 1 which also comprises an oil inlet of the oil pump and an oil filter in fluid communication with the oil inlet and through which oil is drawn prior to entering the oil pump.

11. The modular oil delivery system of claim 4 which also comprises a wire electrically connected to the mounting bracket to provide an alert signal when the float arm makes electrical contact with the mounting bracket.

12. An oil delivery system module for mounting in an oil reservoir through an opening in a wall of the reservoir to supply lubricating oil to an operating combustion engine, comprising:

a mount having a flange constructed to close the opening and be carried by the wall of the oil reservoir, and having a mounting bracket carried by the mount and at least one passage communicating with the exterior of the flange to supply oil to the operating engine;

an oil level sensor carried by the mount inside the oil reservoir when the flange closes the opening and is carried by the wall of the oil reservoir so that is responsive to the level of oil in the oil reservoir; and an oil pump supported by the mounted bracket inside the oil reservoir when the flange closes the opening and is carried by the wall of the oil reservoir and having an oil inlet through which oil from the oil reservoir is received and an oil outlet through which oil is discharged with the oil outlet communicating with said at least one passage in the mount so that oil discharged from the oil pump exits the oil reservoir through the mount to supply lubricating oil to the operating engine.

13. The oil delivery system of the claim 12 further comprising an isolator plate adjacent to the oil pump and formed of a material that is not electrically conductive to prevent electrical communication between the mounting bracket and the oil pump.

14. The oil delivery system of claim 13 further comprising a hingepin carried by the isolator plate and wherein the hinge pin and mounting bracket are electrically conductive.

15. The oil delivery system of claim 14 wherein the oil level sensor includes a float arm that has an electrically conductive portion and is pivotally carried by the hinge pin so that in a low oil condition the electrically conductive portion of the float arm makes electrical contact with the mounting bracket.

16. The oil delivery system of claim 15 which also comprises a wire electrically connected to the mounting bracket to provide a signal when the float arm makes electrical contact with the mounting bracket.

17. An oil delivery system for a 2-stroke engine with a remote oil reservoir with a wall having an opening therethrough, comprising:

a mount having a flange constructed to close the opening in and be carried by the wall of the oil reservoir, and having a mounting bracket carried by the mount and at least one passage communicating with the exterior of the flange to supply oil to the engine;

an oil pump supported by the mounting bracket inside the oil reservoir when the flange closes the opening and is carried by the wall of the oil reservoir and having an oil inlet through which oil from the oil reservoir is received and an oil outlet through which oil is discharged with the oil outlet communicating with said at least one passage in the mount so that oil discharged from the oil pump exits the oil reservoir through the mount and is supplied to the operating engine; and an oil pressure sensor carried by the mount and communicating with the outlet of the oil pump to sense the pressure of oil discharged from the oil pump to the operating engine.

18. The oil delivery system of claim 17 which also comprises an oil level sensor having a pivoted arm carried by the mount, received in the oil reservoir and responsive to the level of oil in the reservoir and wherein at least a portion of the arm and the mount are electrically conductive so that during at least certain oil levels in the oil reservoir the arm is electrically communicated with the mount.

19. The oil delivery system of claim 18 which also includes a float carried by the arm and buoyant in oil in the oil reservoir.

20. The oil delivery system of claim 17 wherein the oil pressure sensor monitors the pressure of oil discharged from the oil pump to the operating engine and is inside the oil reservoir when the flange closes the opening and is carried by the wall of the oil reservoir.

* * * * *

UNITED STATES PATENT AND TRADEMARK OFFICE

CERTIFICATE OF CORRECTION

PATENT NO. : 6,988,590 B1
DATED : January 24, 2006
INVENTOR(S) : L. Knight

It is certified that error appears in the above-identified patent and that said Letters Patent is hereby corrected as shown below:

Column 6,
Line 2, after "bracket" but before the period "." insert -- and an electrical circuit is formed that includes the float arm, hinge pin and mounting bracket --.
Line 45, delete "mounted" and insert -- mounting --.
Line 60, delete "hingepin" and insert -- hinge pin --.

Signed and Sealed this

Twenty-fifth Day of April, 2006

JON W. DUDAS
*Director of the United States Patent and Trademark Office*

UNITED STATES PATENT AND TRADEMARK OFFICE

CERTIFICATE OF CORRECTION

PATENT NO. : 6,988,590 B1
APPLICATION NO. : 10/307614
DATED : January 24, 2006
INVENTOR(S) : David L. Knight It is certified that error appears in the above-identified patent and that said Letters Patent is hereby corrected as shown below:

Column 6,
Line 2, after "bracket" but before the period "." insert -- and an electrical circuit is formed that includes the float arm, hinge pin and mounting bracket --.
Line 45, delete "mounted" and insert -- mounting --.
Line 60, delete "hingepin" and insert -- hinge pin --.

This certificate supersedes the Certificate of Correction issued April 25, 2006.

Signed and Sealed this

Ninth Day of December, 2008

JON W. DUDAS
*Director of the United States Patent and Trademark Office*